US005304337A

United States Patent [19]

Chen et al.

[11] Patent Number: 5,304,337

[45] Date of Patent: Apr. 19, 1994

[54] GLOVE FORMING METHOD

[75] Inventors: Fung-Bor Chen, Sandy; Wu-Nan Huang, Salt Lake City, both of Utah; Carl M. Rogers, Ware Shoals, S.C.

[73] Assignee: Becton, Dickinson and Company, Franklin Lakes, N.J.

[21] Appl. No.: 289,528

[22] Filed: Dec. 27, 1988

Related U.S. Application Data

[62] Division of Ser. No. 35,824, Apr. 8, 1987, Pat. No. 4,809,365.

[51] Int. Cl.[5] ..... B29C 41/14; B29L 31/48

[52] U.S. Cl. ..... 264/303; 264/304; 264/306; 264/307; 264/334; 264/342 R; 264/344; 425/275; 425/446; 53/396

[58] Field of Search ..... 264/303-308, 264/334, 344, 342 R; 2/168, 169; 425/275, 446; 53/396

[56] References Cited

U.S. PATENT DOCUMENTS

| | | | |
|---|---|---|---|
| 2,716,241 | 8/1955 | Goodman | 2/169 |
| 3,268,647 | 8/1966 | Hayes et al. | 264/303 |
| 3,541,609 | 11/1970 | Poulacs et al. | 2/168 |
| 3,852,826 | 12/1974 | Schindler | 2/168 |
| 3,872,515 | 3/1975 | Miher et al. | 2/168 |
| 4,133,624 | 1/1979 | Heavner et al. | 2/168 |
| 4,143,423 | 3/1979 | Sternlieb | 2/169 |
| 4,519,098 | 5/1985 | Dunmire et al. | 2/169 |
| 4,540,407 | 9/1985 | Dunn | 2/168 |
| 4,668,224 | 5/1987 | Lentz et al. | 2/168 |

FOREIGN PATENT DOCUMENTS

| | | | |
|---|---|---|---|
| 2448746 | 4/1976 | Fed. Rep. of Germany | 2/168 |
| 2100580 | 1/1983 | United Kingdom | 2/168 |
| 2181691 | 4/1987 | United Kingdom | 2/168 |

*Primary Examiner*—Jeffery Thurlow
*Assistant Examiner*—Mathieu Vargot
*Attorney, Agent, or Firm*—Aaron Passman

[57] ABSTRACT

A glove configuration and method for making same of a thin flexible film is shown. The glove and form having an ambidextrous shape useful for either the left or right hand use and a cuff configuration which resists roll-down. The configuration of the cuff includes a corrugated portion and a broadly fluted portion. The former giving increased strength and thickness and the latter providing a place to improve the ease with which the glove may be stripped from its dipping form.

6 Claims, 4 Drawing Sheets

GLOVE FORMING METHOD

This is a division of application Ser. No. 035,824, filed Apr. 8, 1987, now U.S. Pat. No. 4,809,365.

BACKGROUND OF THE DISCLOSURE

This relates to flexible thin film gloves such as those dipped or molded from latex, rubber, vinyl, and other similar film forming materials. These gloves are usually fabricated over molds by dipping and drying operations usually composed of several steps in order to develop the preferred glove film thickness. In particular, this disclosure relates to the specific shape and form of the hand and cuff areas for the dipped glove. The thickness and strength of the cuff area is important to the manufacture and subsequent use of the glove. The shape of the preferred glove in the hand portion is designed for use with either the left or right hand.

In the prior art there is disclosed gloves having configurations in and about the wrist and cuff area which are included there for various purposes including strength. See for example U.S. Pat. No. 3,268,647 which discloses techniques in the prior art. The process taught therein is for making a glove with a thicker cuff portion. In particular, longitudinal flutes are provided in the cuff area which permit more latex to be incorporated into the cuff area during the dipping operation. Upon drying and vulcanizing that additional cuff material is stretched out of the valleys of flutes thus covering (linearly around the circumference of the wrist) across the chordal distances, a shorter span. The material provided during the dipping process, to cover the valley of the fluted wrist and cuff portion of the glove form, now covers a smaller circumferential span because of the shrinkage during the drying process. Consequently, the cuff film thereabout is thicker.

Another approach which is said to resist cuff roll down is shown in U.S. Pat. Nos. 4,095,293 and 4,133,624, wherein a combination of circumferential channels in the wrist and cuff portion cooperate with a plurality of longitudinal flutes in the wrist and cuff areas to form a waffle pattern of crisscrossing configuration which are slightly constricted and act as a reinforcing band around the cuff of the glove. The overall pattern where the crossing takes place produces a waffle grid configuration which is said to resist rolldown and enhance the thickness of the glove at the bottom or base of each of the channels.

OBJECTS OF THE DISCLOSURE

An objective of this disclosure is to introduce a glove shape and the form for manufacturing the glove shape which produces a finger and hand portion that can be used ambidextrously on either the left or right hand.

Another object of the disclosure is to teach a reinforcing configuration for the cuff portion of the glove which allows easy stripping of the finished glove from the glove form and thereafter during use resists cuff rolldown.

It is a still further object of the disclosure to teach a cuff configuration which has strength sufficient to permit donning and removal of the glove without cuff failure.

SUMMARY OF THE DISCLOSURE

Disclosed is an ambidextrous glove, a form for same, and the glove manufacturing process. The glove form includes a smooth surface in part defining the finger and hand portion of the glove and the form is shaped symmetrically with respect to a longitudinal plane that extends through the fingers. The longitudinal plane is, relative to the glove form, such that it bisects the hand. The thumb in a side view is in line with the fingers and all of them are bisected longitudinal by the plane. In the context of this disclosure longitudinal means in line with the elongated dimension of the hand or vertical if the hand is held open and upright (such as to signal stop).

The preferred glove and form have a cuff portion which is specifically configured to provide ease of glove stripping (removal from its form) during the manufacturing operation. Reinforcement is a part of the cuff shape to prevent failure during use of the glove such as donning or removal. Also, the configuration is such that the film in the area of the glove about the cuff is thicker and therefore stronger to resist cuff rolldown.

The specific form upon which the glove is made has a roughened area in terms of surface finish beneath the area of the cuff portion and the form includes one broad longitudinal flute which extends from the base of the thumb where same joins the wrist portion of the glove downwardly to the base of the glove. This single broad flute permits sufficient extra material to be provided in the flute area and upon drying the extra material is shrunk and stretched out of the valley to create a space between the glove and the flute valley such that the glove is easily stripped from its form. The broad flute enhances the thickness of the material covering the flute area giving strength where the flute portion of the glove is stressed during removal of the glove from the form. Extending from the broad flute circumferentially and laterally (normal to the longitude) about the base of the cuff are a series of corrugations which are formed of raised bands separated by indented grooves that provide a parallel reinforcing structure. The corrugated cross-sectional configuration does not extend across the broad flute portion as the needs of these areas are somewhat different. That is to say that, the broad flute provides means and strength for ease of removal of the glove from the form while the corrugations provide thickness and strength, and resist roll down. The cuff area corrugations are spaced away from the palm of the hand portion. The band and groove combination is such that as the glove is manufactured the film forming liquid is retained along, across and over the corrugations during the drying operation so as to enhance the cuff thickness of the glove. The surface of the corrugations and grooves being roughened resists the off flow of glove forming liquid and aids in building up a greater thickness of film material in this critical reinforcing area.

The preferred glove and mold therefor have been found to be measurably easier to use in manufacture since stripping the finished glove from the mold is easier, and because the resulting glove has measurably thicker film in the area of the reinforced cuff portion. The lack of the known waffle pattern or multitude of flutes has not affected the performance; and this new configuration has given an improved result.

passing through the middle thereof thus giving the glove its ambidextrous nature.

Figure 2:
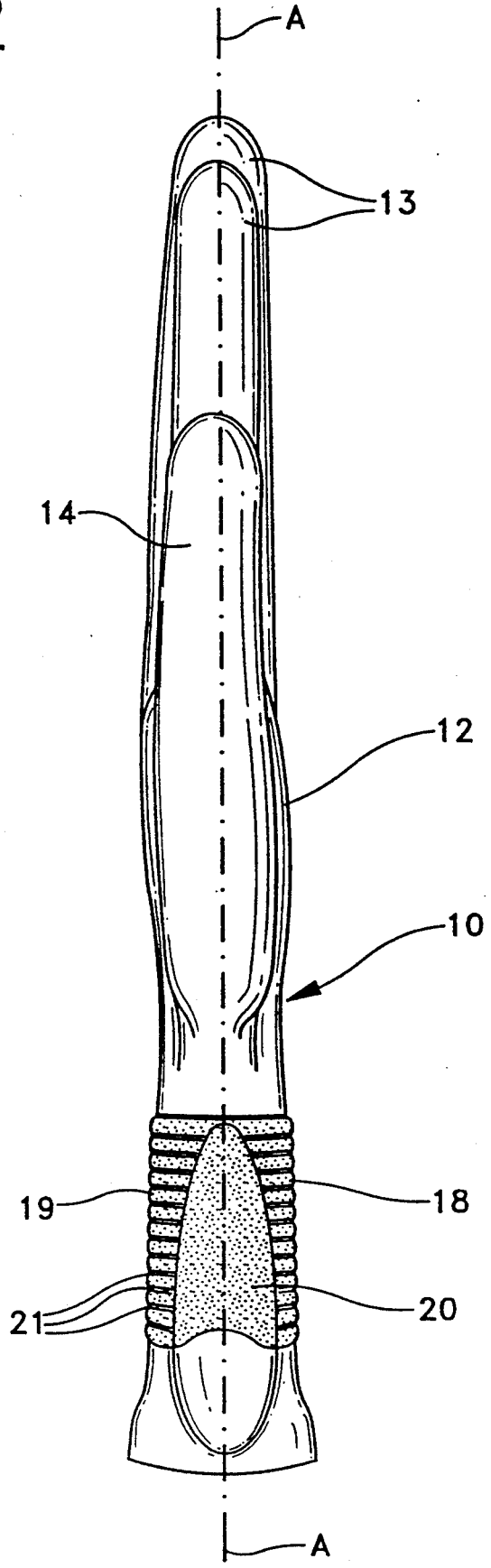
FIG. 2 is a thumb side elevational view of the glove in FIG. 1 showing the symmetry of the glove with respect to a longitudinal plane (shown in phantom line)
Figure 3:
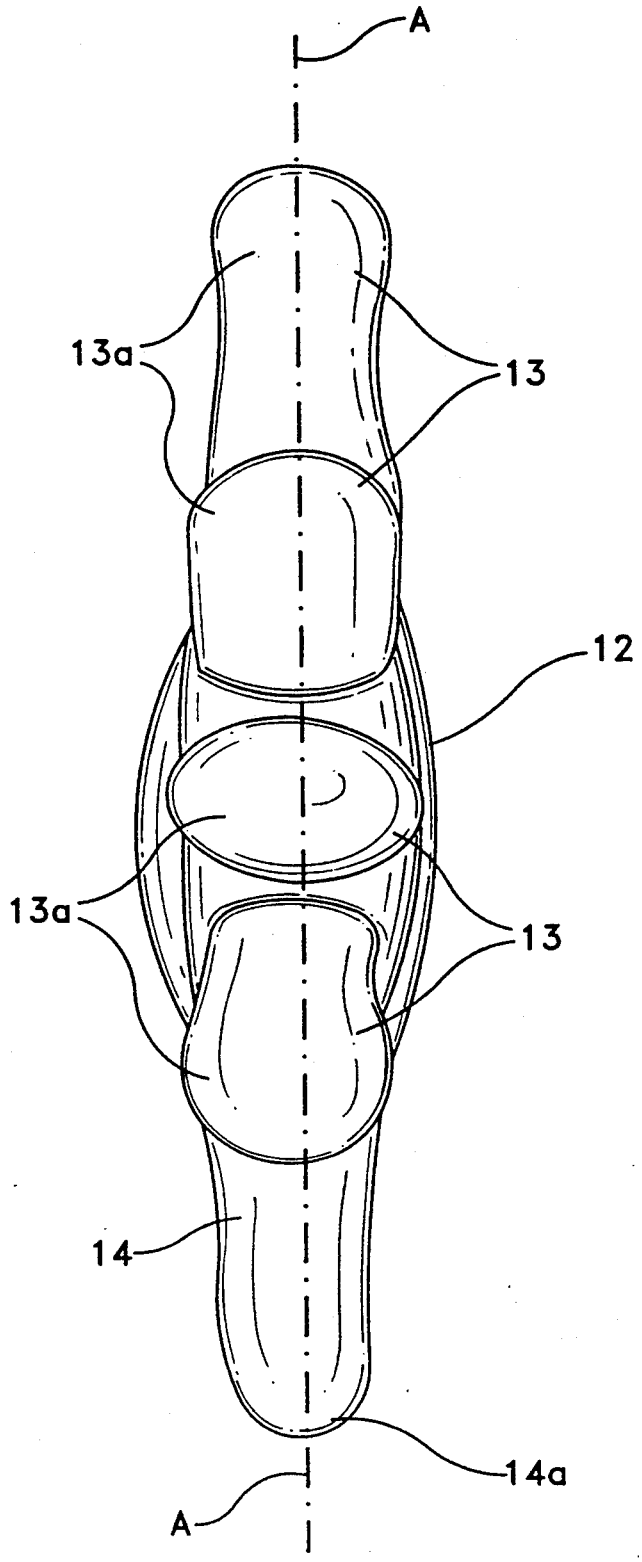
Figure 4:
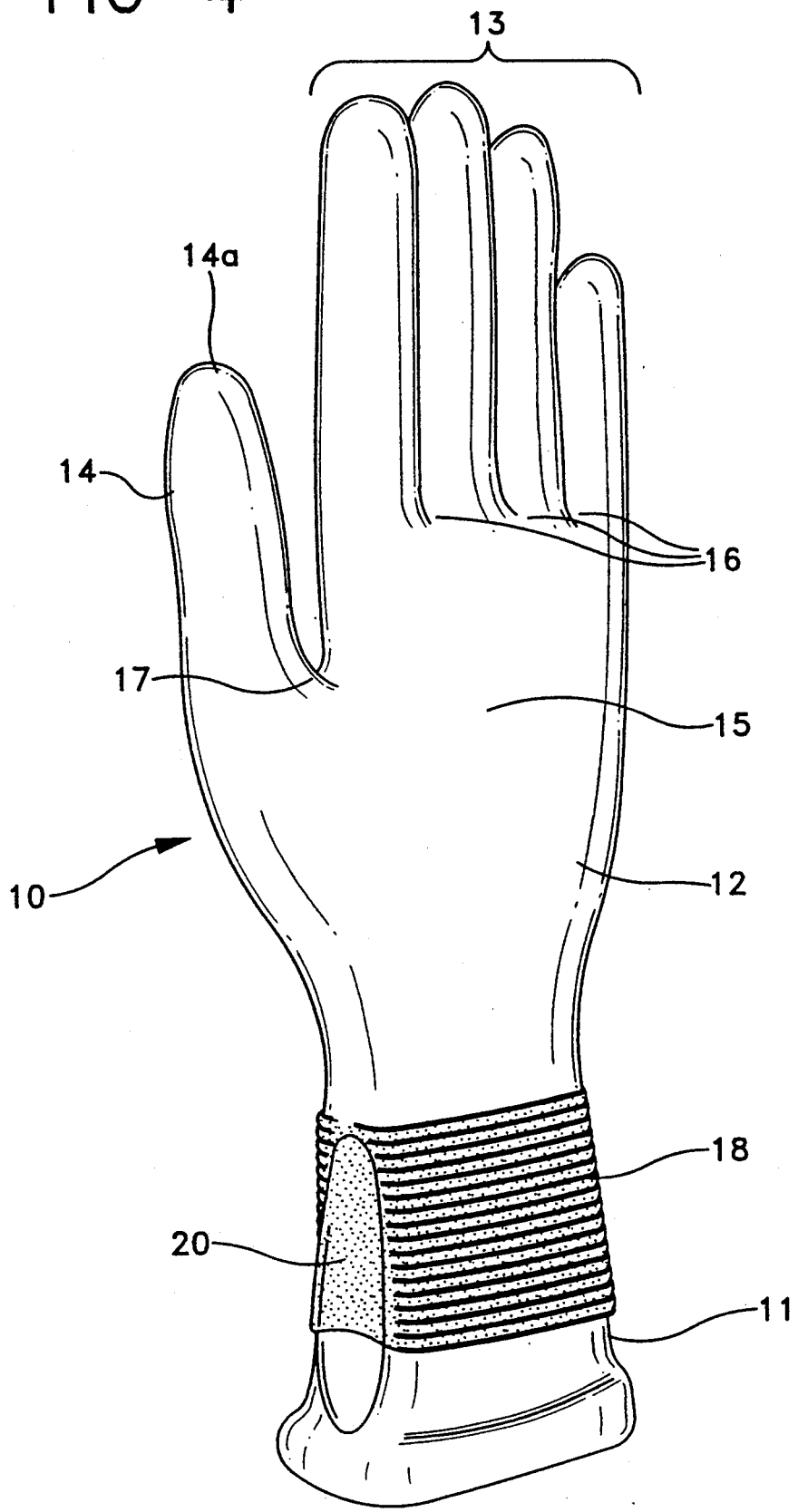

FIG. 3 is a top plan view of the glove of FIG. 2 showing also the symmetry of the glove relative to the plane through the middle thereof, and FIG. 4 is a perspective view of the glove shown in the foregoing figures.

DETAILED DESCRIPTION OF THE DISCLOSURE

FIGS. 2 and 4 shows a front or back elevational view of an ambidextrous glove generally designated 10. Since this glove looks the same in the front or the back and has no side curvature, it can be used either on a left or right human hand, wherefore the ambidextrous nature of this particular glove configuration. In particular, the glove is symmetrical about a longitudinal plane passing through the middle thereof, see for example, FIGS. 2 or 3 for plane A—A.

The glove 10 is formed over a form 11 which has essentially the same shape as the glove 10. The form 11 appears only in the drawings as a portion extending downwardly from the base of the completed glove. Form 11 can be made of porcelain or any other materials which will resist the effects of the dipped materials and will not produce any adverse effects on gloves. The form 11 can be fashioned with a surface finish which is acceptable for glove manufacture. In the particular configuration disclosed, the glove form 11 has a smooth surface finish in the hand and palm and upper wrist areas, and has a roughened surface finish in the lower wrist and cuff portion. The reason for the finish on the form relates directly to the desired thickness of the glove in those specific areas. The hand portion 12 includes the finger and the thumb and palm areas as its major portion.

The fingers are generally designated 13 and the thumb 14. All of which join to a palm or back portion generally designated 15. Because of the ambidextrous nature of the glove, the palm or back 15 are identical. Each of the fingers 13 are generally cylinders of ellipitical cross-section in shape and end with a round tip 13*a*. The thumb is similarly shaped and it has a nearly spherical tip 14*a*. Between each of the finger there is a web portion 16 which completes the glove and makes it water proof, continuous and sanitary. Similarly, at the base of the thumb where same joins the palm or back portion 15 is a web for the thumb 17. These constructions are generally standard except for the attention to symmetry and are a consequence of cleaning, dipping and drying operations consisting of:

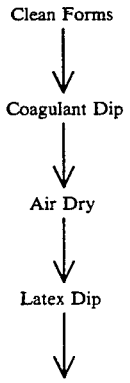

-continued

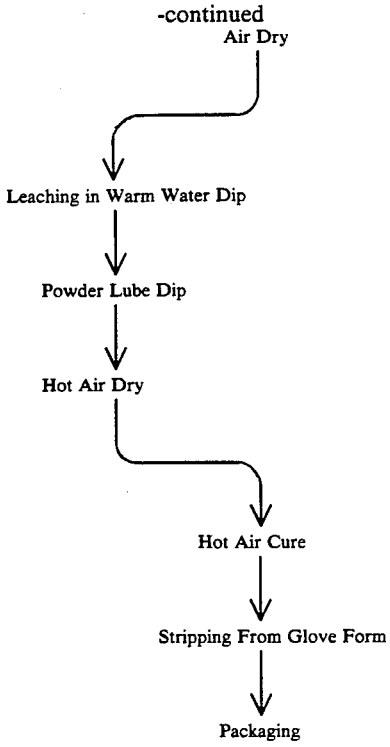

In its most basic description, the dipping process consists of moving a plurality of glove forms into a tank containing latex or some other liquid glove forming film. The glove forms are lowered and raised at a certain rate and are thereafter carried to an oven for drying. Usually the forms are made of unglazed porcelain, glass or aluminum and are dipped into the latex and then withdrawn. Since each dip forms only a thin film, usually more than one dip is required to build up an adequate wall thickness. A thin film of vulcanized rubber is formed upon drying. The film takes the shape of the glove form. In the glove herein the wall thickness of the hand portion is preferred to be kept thinner in order to enhance tactility whereas the portion of the glove in the lower wrist and cuff area is preferred to be thicker in order to improve reliability during glove stripping and to prevent cuff rolldown during use. The gloves formed according to the preferred process are used for surgical or examination purposes and must have to have complete continuity of film, must be manufactured with sufficient thinness in the hand portion area to allow the user to have great sensitivity of touch, but must have thickness in the cuff portion to prevent the unsanitary condition of the inside of the glove rolling down, exposing the surgeons gown sleeve and touching the sterile outside of the glove.

The wall thickness can be increased over the entire glove by the use of a coagulant dip in combination with the latex. The coagulant causes the latex to gel and, therefore, a thicker overall coating is formed on the glove form. Then the film and the form are placed in an oven for drying.

Figure 1:
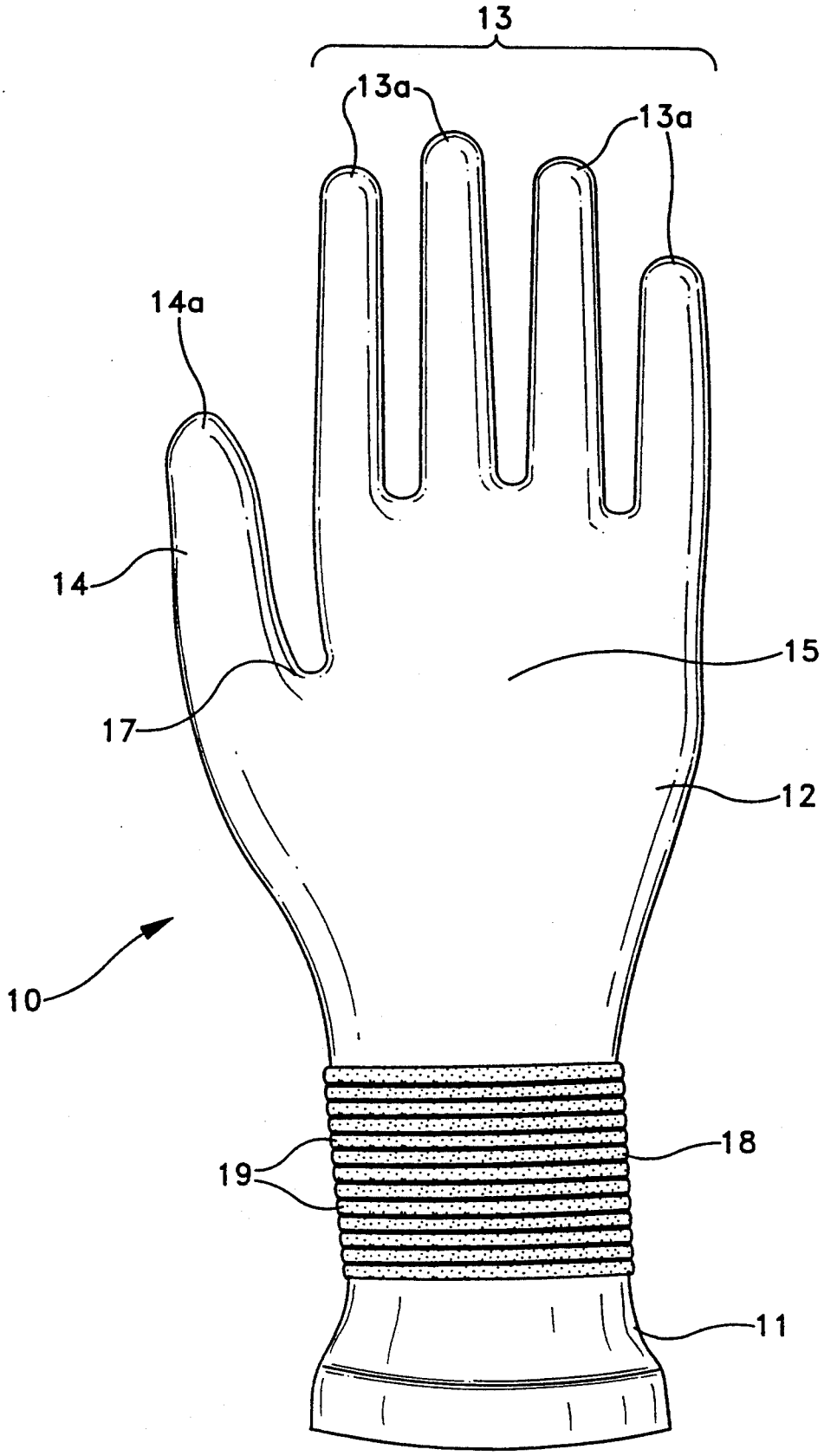
FIG. 1 is a front or back elevational view of an ambidextrous glove produced in accordance with the shape of the preferred mold.

In the preferred embodiment shown in the figures, the cuff portion has two structural details which enhance its overall strength and increase its thickness during the dipping process. In particular, the cuff portion generally designated 18 and best shown in FIGS. 1, 2, and 4 includes a series of lateral corrugations or ribs 19 which extend most of the way about the cuff portion 18. The ribs 19 terminate at a longitudinal flute 20 best shown in FIG. 2. The flute 20 extends from the base of the thumb to or beyond the base of the glove and represents an area of concaved inwardly positioned material which upon drying extends across the flute in a chord like fashion (not shown) and has a reduced length such that the thickness of the material thereacross is increased. The area of the form beneath the cuff portion is roughened, i.e., not a smooth surface finish, such that as the dipped material is flowing and/or gelling thereover in the dripping process a greater film thickness adheres to the surface of the glove form in this area than in the hand portion 12 which is completely smooth and allows the thin film to form without restraint to the off flow of the dipped liquid. The ribs 19 are composed of a series of corrugations separated by a number of narrow grooves 21 best shown in FIG. 2. The corrugations are not really high relative to the surface of the glove and are there merely to restrain the off flow of glove film forming liquid during the dipping process. Therefore, the distance traveled by the liquid and its drip off is greater because of the corrugations of ribs 19 and their separating grooves 21. The form has a gentle shape in the rib and groove area, i.e., no sharp edges. The glove film which forms thereover is even more gentle in configuration.

Thickness measurements made of gloves prepared by using the preferred configuration and other configurations prove the value of the form disclosed herein. Enhanced cuff and wrist thickness are measureable.

| | Cuff and Wrist of This Disclosure | Surgical Flute Form Per U.S. Pat. No. 3,268,647 | Smooth Cuff Form - No Flutes, Ribs or Waffel Pattern |
|---|---|---|---|
| Thickness, mil | 7.2 | 6.5 | 6.2 |
| Cuff | | | |
| Wrist | 6.2 | 6.0 | 6.0 |

The draining of the film forming liquid is a function of many parameters; such as, humidity, temperature, dipping sequences (exit speed, form rotation, etc.) thickness of the film formed during the dipping operation, and particular dip materials selected. As the drying proceeds a layer of latex rubber is formed on the surface of the glove form 11 and with each successive dip the thickness of the layer increases and the rate of drying slows because the diffusion of water vapor from the inner layers of film is slowed by the outer layers and the amount of water on the glove form is increased. In the drying oven, the air flow is kept at a gentle and even rate in order to prevent shrinkage of the film, which would result in flaws to the continuity of film over all the portions of the glove. This concern is even greater with thin films such as those used in the hand portions of surgical gloves as defects would certainly be apparent and the resulting product unacceptable.

In order to strip the gloves the finished dried film is grasped under the flute 20 and the glove is pulled slightly outwardly and longitudinally toward the tip of the glove. During this process the film is everted such that the resulting glove is actually inside out. In order to help gloves stripping some kind of donning powder or glove lubricant can be applied to the glove form 11 before the latex dipping process. This donning powder, for example, modified corn starch remains with the glove as same is removed from the form. Removal of the glove from the form everts the glove such that it is inside out. The outside of the glove will have the donning or lubricating powder that it has picked up from the form while the inside of the glove will have to be powdered in order to make same easy to use. In connection with the removal of the glove from the form, tests have been run to show how the preferred design of this disclosure functions with respect to stripping from the form. Tests have been run to show that the single flute glove of the present disclosure is better than that of the multi-flute glove of U.S. Pat. No. 3,268,647.

TEST RESULTS OF COMPARISON STRIPPING

| | Cuff Design of This Disclosure | Surgical Flute Form Per U.S. Pat. No. 3,268,647 | Smooth Cuff Form No Flutes, Ribs or Waffel Pattern |
|---|---|---|---|
| Stripping glove in seconds for removal from form | 3 | 3.2 | 5.2 |
| Stuck Cuff* % of gloves | 1.4 | 3.4 | 3.6 |

*Glove stuck to itself in the cuff area.

In addition to the improved ease of stripping as shown in the results of the testing included in the table above, the cuffs tend to wrinkle and pucker together forming what is called a stuck cuff. This is unsatisfactory in that it becomes difficult to package the glove and subsequently use it in this form. Those knowledgeable about the packaging and use of surgical gloves appreciate that same have to be free and open at the cuff end for ease of insertion of the surgeon's hands without loosing the sterility of the outside. For this purpose, the cuff is folded over toward the outside and the glove is laid in an open fashion. One glove on one side and the other opposite the first when the package holding same is folded open to present the gloves for receipt of the surgeon's hands. The outside surface of the glove is therefore protected and kept sterile as the surgeon's hands only touch the inside of the glove. Once a glove is on, the gowned area of the surgeon's other gloved hand is used to fold the cuff down over the surgeon's gown sleeve; thus maintaining sterility of the exterior surface of the donned glove. It can be appreciated that a severely stuck cuff would not be an acceptable condition in which a glove is packaged as that would not allow its use without loss of a sterile field across the exterior glove surface.

Those skilled in the art will no doubt appreciate that minor modifications to the configuration of the ambidextrous reinforced cuff glove shown, disclosed and explained in the foregoing specification can be made. Modifications to materials, the dipping process and minor changes in the arrangement of the ribs, grooves and the flute are expected to be included in the claims which follow.

What is claimed is:

1. A method for forming a glove with the following steps:

providing clean but powder lubricated forms configured to make a glove with a single flute extending from the base of the thumb across the cuff and having a rib-like lateral semi-circumferential area about the cuff from one side of the flute to the other, dipping the forms into a coagulant bath, restraining the off flow during the dripping of the dipped coagulant across the rib-like lateral semi-circumferential area about the cuff for forming a greater thickness in the area, drying the dipped forms in air, dipping the dried coagulant film covered forms into a latex bath, restraining the off flow during the dripping of the dipped latex across the rib-like lateral semi-circumferential area about the cuff for forming a greater thickness in the area, drying the dipped forms and film layers in air thus shrinking and stretching film material deposited in the flute during the dipping, creating a space between the glove and the flute on each form, leaching the forms and film layers in water dip, dipping film covered forms in powder lubricant, drying the powdered film in hot air, curing the powdered film in hot air, and stripping the film from each of the glove forms by grasping within the space and pulling slightly outwardly and longitudinally away from the base to evert the glove.

2. The method of claim 1 wherein the step of dipping in a latex bath forms a cuff portion film thickness about one mil thicker than a hand portion thickness.

3. The method of claim 1 wherein the step of drying is performed in an oven at a gentle and even rate to prevent shrinkage of the film.

4. The method of claim 1 wherein the step of providing a powdered lubed form is accomplished with a modified corn starch.

5. The method of claim 1 wherein the step of stripping is performed rapidly leaving the cuff of the stripped glove unstuck and without wrinkles or puckers which would cause difficulty donning.

6. The method of claim 1 with the additional step of packaging a pair of stripped gloves.

* * * * *